US005083768A

United States Patent [19]

Ertavi et al.

[11] Patent Number: 5,083,768

[45] Date of Patent: Jan. 28, 1992

[54] DEVICE FOR REDUCING THE VELOCITY OF IMPACT OF PRINTED PRODUCTS IN THE BASE OF A DELIVERY PADDLE WHEEL OF PRINTING PRESSES

[75] Inventors: Tibor Ertavi, Kirchberg; Jürg Bürki, Burgistein, both of Switzerland

[73] Assignee: Maschinenfabrik Wifag, Bern, Switzerland

[21] Appl. No.: 502,065

[22] Filed: Mar. 29, 1990

[30] Foreign Application Priority Data

Mar. 30, 1989 [DE] Fed. Rep. of Germany ..... 3910333

[51] Int. Cl.[5] ..... B65H 29/40; B65H 29/68

[52] U.S. Cl. ..... 271/182; 271/187; 271/315

[58] Field of Search ..... 271/187, 315, 182

[56] References Cited

U.S. PATENT DOCUMENTS 3,685,823 8/1972 Chambon ..... 271/182

4,600,186 7/1986 von Hein ..... 271/315 X

*Primary Examiner*—Richard A. Schacher

*Attorney, Agent, or Firm*—McGlew & Tuttle

[57] ABSTRACT

A delivery paddle wheel (1) for delivering printed products (6) in an imbricated pattern is associated with a shaft (8) with cam plates (9) mounted on the shaft (8) and cams (10) mounted on the cam plates (9), which are in operative connection with rollers (22). The shaft (8) is arranged mounted on levers (7) pivotable around the axis (2) of the delivery paddle wheel (1). The cams (10) of the cam plate (9) catch the printed products (6) arriving in the delivery paddle wheel (1) at their trailing end (26) and decelerate them. The setting of the cam plates (9) for printed products (6) with different lengths is performed by swiveling the levers (7). The shaft (8) is driven by a drive member (17), which is arranged on a rocking lever (13) that can be pivoted around shaft (8) and is guided by longitudinal guides (18) in the radial direction relative to the delivery paddle wheel (1). The position of the cam plates (9) relative to the different lengths of the printed products (6) is therefore optimal for each setting.

7 Claims, 4 Drawing Sheets

DEVICE FOR REDUCING THE VELOCITY OF IMPACT OF PRINTED PRODUCTS IN THE BASE OF A DELIVERY PADDLE WHEEL OF PRINTING PRESSES

FIELD AND BACKGROUND OF THE INVENTION

The present invention pertains to a device for reducing the velocity of impact of printed products in the base of a delivery paddle wheel of printing presses. The device includes rotated cam plates which are in operative connection with rollers and one cam plate-roller pair being arranged in each intermediate zone of disc-shaped petal parts of the delivery paddle wheel.

Such a device is known from West German Offenlegungsschrift No. DE-OS 34,06,069. Here, cam plates are arranged on double lever-like arms mounted rotatably around the paddle wheel axis between the paddle wheel disks. Rings are arranged on a rotatable shaft in operative connection to the cam plates. This shaft is mounted in a frame surrounding the delivery paddle wheel, which frame is adjustable jointly with the double lever-like arms around the delivery paddle wheel via an adjusting device. This adjustment serves to guarantee that the product is caught and decelerated at the trailing end and before impacting on the base of the paddle when changing the production over to a product with a different format, which is manifested as different product lengths in the delivery paddle wheel. With the drive configuration used in this device, it is necessary to additionally adjust the cam plates in the new position. This additional adjustment of the cam plates makes readjustment during the operation of the printing press and automation of the adjustment difficult.

SUMMARY AND OBJECT OF THE INVENTION

It is an object of the present invention to provide a device for reducing the velocity of impact of printed products in the base of a delivery paddle wheel, which permits simple adjustment to different format lengths of printed products even with the press running and in which the cam plates are in an optimal location relative to the printed products for each setting.

According to the invention, the cam plates are mounted on a common shaft which is mounted rotatably on at least one lever. The lever is arranged outside the delivery paddle wheel and is pivoted around the delivery paddle wheel axis. A rocking lever is provided mounted on the cam plate shaft with one end being pivoted and the other end provided with a rigidly mounted pin. The rigidly mounted pin is guided between longitudinal guides which are rigidly connected to a printing press frame. The common shaft is driven at a transmission ratio i from a drive member which is arranged on the pin of the rocking lever. The ratio of the effective length of the lever to the effective length of the rocking lever is substantially the same as the transmission ratio i to 1—1.

The position of the leading edge of the printed products delivered by the folding device into the delivery paddle wheel relative to the delivery paddle wheel is always the same, regardless of the length of the printed products. It is achieved with the device according to the present invention that when setting the position of the cam plates, which cam plates must be aligned with the trailing end of the printed product, which depends on the length of the printed product, the position of the cams relative to the printed products always remains optimal. Based on a set position of the cam plates, in which one of the cams is directed toward the axis of the delivery paddle wheel, this cam is always directed against the axis of the delivery paddle wheel during the adjustment of the position of the cam plates while the press is not running. This is ensured by the practically complete agreement of the ratio of the effective length of the lever to the effective length of the rocking lever and the transmission i (drive member to cam plate shaft) of i—1.

Advantageous dimensions for lever lengths and drive transmission occur at a ratio on the order of magnitude of two. No excessive pivoting angles are now obtained for the levers, and the drive members also fail to show excessively large dimensions.

The longitudinal guide for the rocking lever is advantageously arranged on the straight connecting line between the axis of the delivery paddle wheel and the cam plate shaft when the cam plates are located in the middle of their range of adjustment. The longitudinal guides for the pin of the rocking lever are also arranged so that the pin is moving in said straight line. Symmetrical behavior is thus achieved for the setting of both the printed products with the smallest length and for printed product with the greatest length.

According to another advantageous design of the device, the levers arranged on both sides of the delivery paddle wheel are extended beyond the delivery paddle wheel and are connected to each other by a web. The roller levers carrying the roller, which levers are mounted pivotably between the disk-shaped paddle parts of the delivery paddle wheel on the wheel's axis, and whose rollers, which form the decelerating mechanism for the printed product together with the cam plates and maintain their position relative to the cam plates even during adjustment, can also be connected to the same web.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DETAILED DESCRIPTION OF THE PREFERRED EMBODIMENT

Figure 1:
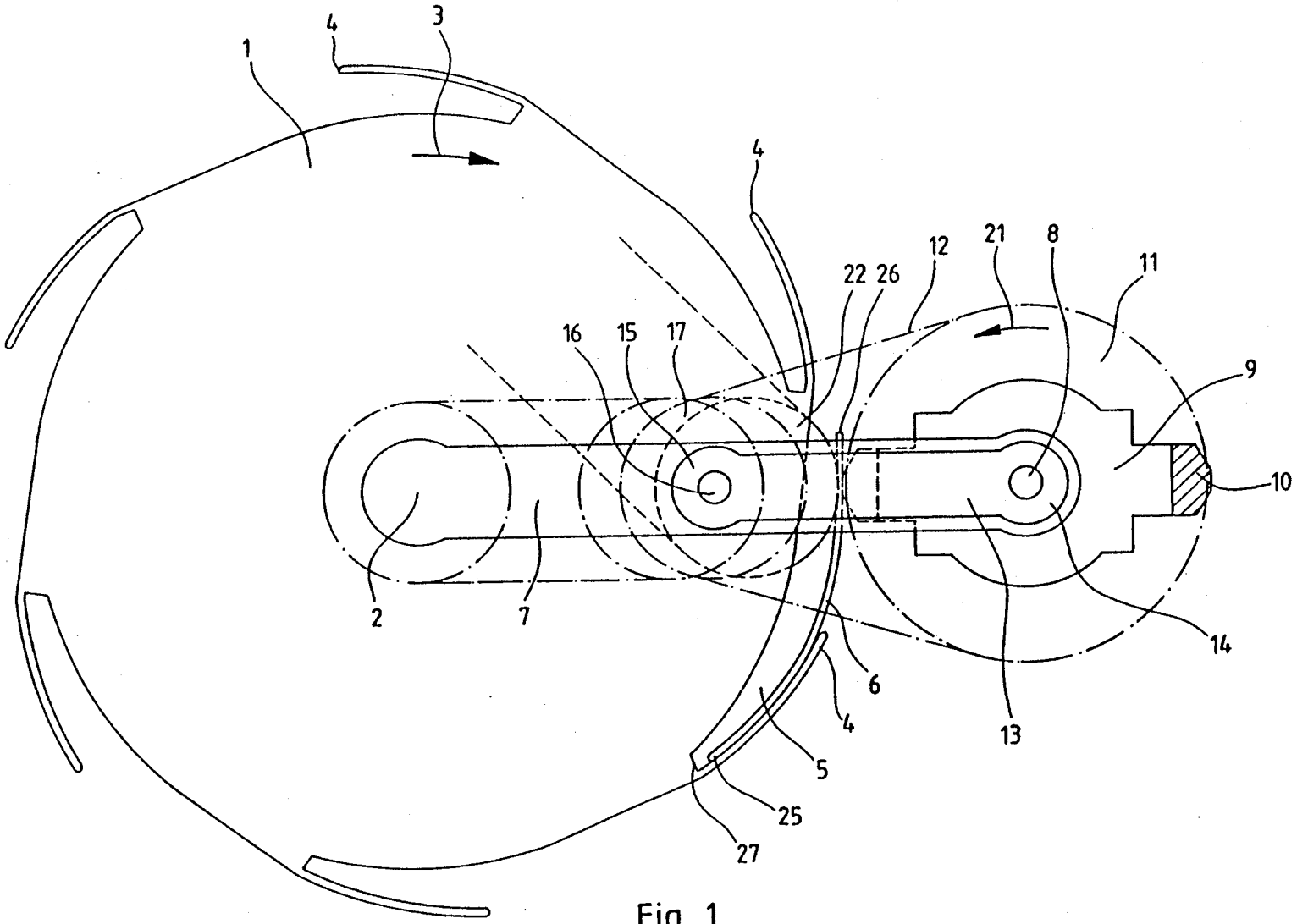
FIG. 1 is a schematic view of the device in the middle position.
Figure 2:
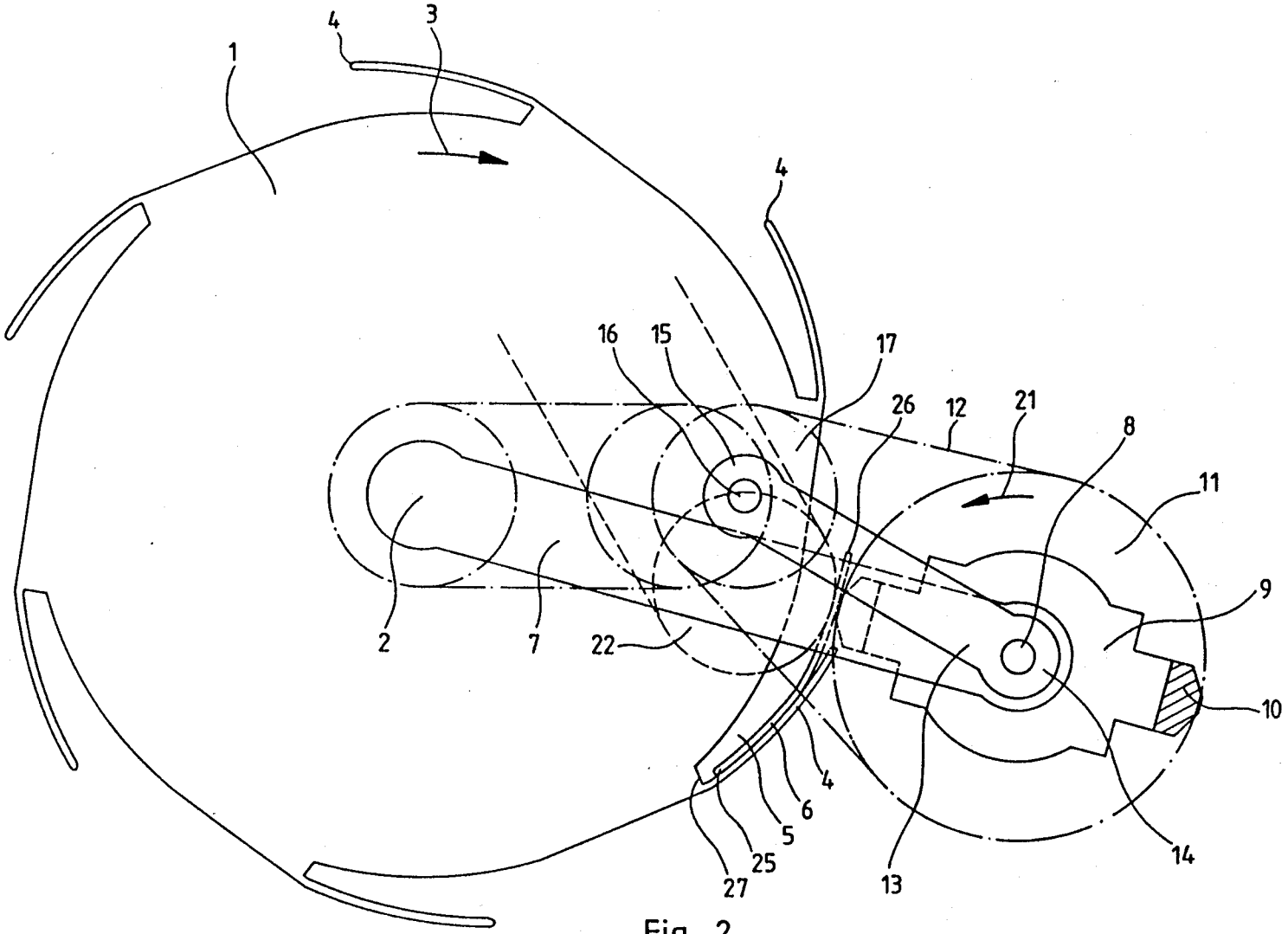
FIG. 2 is a schematic view of the device in the position for short products.
Figure 3:
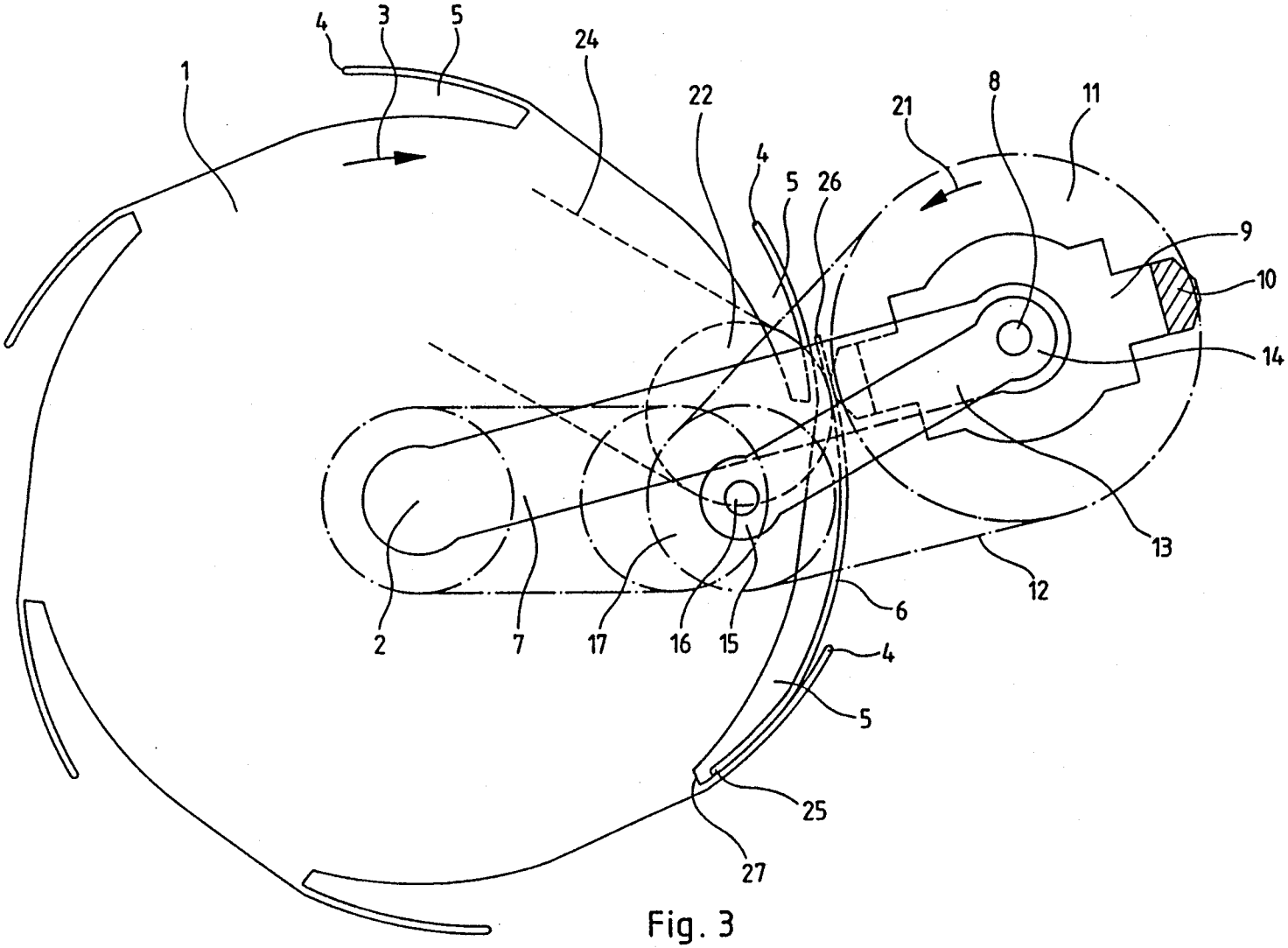
FIG. 3 is a schematic view of the device in the position for long printed products; and, FIG. 4 is a sectional view taken along line IV—IV in FIG. 1.

According to FIG. 1 through FIG. 3, the delivery paddle wheel 1 is rotatable around axis 2 and is driven in the direction of arrow 3. The paddles 4 form pockets 5 into which the printed products 6, delivered from the folding device, are inserted. The pockets are arranged on the circumference of the delivery paddle wheel 1 in order to be subsequently laid out in an imbricated pattern.

Levers 7 are mounted pivotably around the axis 2 on both sides of the delivery paddle wheel. A shaft 8, on which cam plates 9 are mounted, is mounted rotatably in the levers 7. Each of the cam plates 9 is equipped with cams 10. The shaft 8 is provided with a toothed belt gear 11, which is driven via a toothed belt 12 in the direction of arrow 21. One end 14 of a rocking lever 13 is hinged on the shaft 8. A pin 16 is inserted in the other end 15. A drive member 17, which is designed as a toothed belt gear and drives the toothed belt 12, is mounted rotatably on the pin 16. The pin 16 is guided by longitudinal guides 18 (FIG. 4), which permit pin 16 to be moved to and fro in the radial direction relative to the delivery paddle wheel 1. The toothed belt gear 17 is connected via a coupling 19 (FIG. 4) to a driving device 20 that is rigidly attached to the printing press frame. The driving device 20 is coupled with the machine drive in the known manner.

The cam plates 9 cooperate with rollers 22. The rollers 22 are arranged between the disk-shaped paddle parts 23 (FIG. 4) and each of them is rotated individually via a drive 24.

The printed products 6 enter the pockets 5 formed by the paddles 4 in cadence with the delivery paddle wheel 1. The point in time at which the printed product 6 enters into the pocket 5 always remains the same for the front edge 25 of the printed product 6, regardless of its length. The printed products 6 entering the delivery paddle wheel 1 at high speed ar briefly stopped and decelerated by the cam 10 arriving at their trailing end 26. The printed products 6 are then released by the cam 10, and immediately after they are released, the printed 6 products reach the base 27 of the pocket 5 at reduced speed, and they are decelerated there to the final velocity at which the delivery paddle wheel 1 is driven. Since the last speed difference is small, the printed products 6 reach the base 27 of the pocket 5 without being damaged and without rebounding, which will permit delivery in a perfect imbricated pattern.

FIG. 1 shows the position of the cam plates 9 for a printed product 6 of medium length.

FIG. 2 shows, with the delivery paddle wheel 1 in the same position as in FIG. 1 and, the position of the cam plates 9 for a printed product 6 with the smallest length. To guarantee optimal deceleration of the printed product 6, the cam plates 9 are swiveled with the corresponding rollers 22 into the position shown. Thus it is achieved by the design according to the present invention that the cams 10 remain in the optimal position relative to the trailing end 26 of the short printed product 6. In this setting, the pin 16 is displaced along the longitudinal guides 18 in radial direction relative to the delivery paddle wheel 1. The cam plates 9 are turned back slightly due to the dimensions selected, i.e., the cam 10, which is shown in the engaged position, always points toward the axis 2 of the delivery paddle wheel.

FIG. 3 shows the position of the plates 9 for a printed product 6 with the greatest length, again in the same position of the delivery paddle wheel 1. The behavior is exactly the opposite to the situation shown in FIG. 2 because of the symmetry relative to the middle position.

Figure 4:
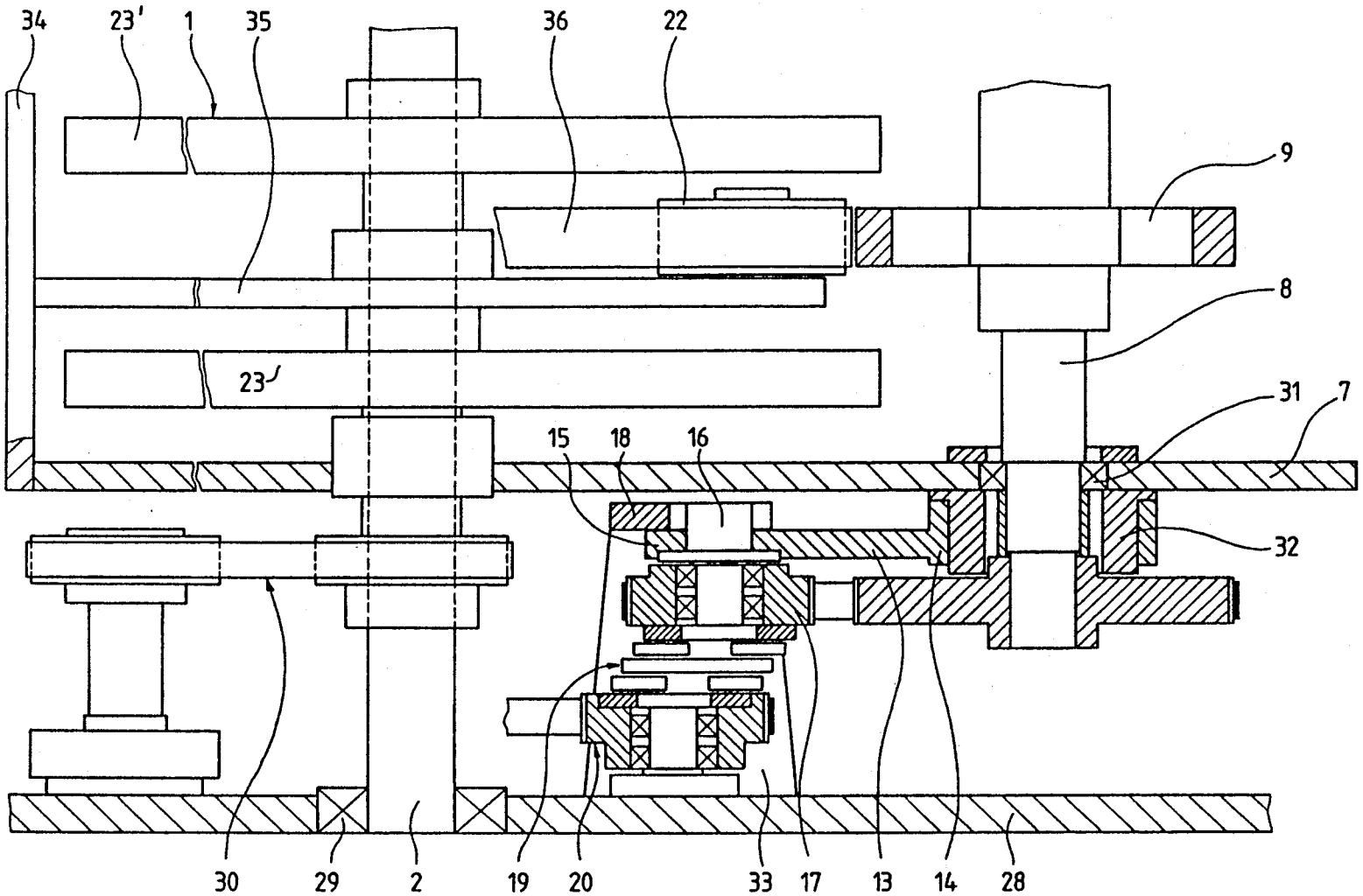

The axis 2 of the delivery paddle wheel 1 is held in bearing 29 in the side wall 28 shown in FIG. 4. A schematically represented drive 30 rotates the delivery paddle wheel 1. The levers 7 are arranged pivotably around the axis 2 on both sides of the delivery paddle wheel 1; FIG. 4 shows only one side. The shaft 8 is held in the lever 7 by bearing 31. One end 14 of the rocking lever 13 is mounted on a bearing bush 32 and is pivotable. Its other end 15 is provided with the pin 16, which is guided in the longitudinal guides 18, which are fastened to the side wall 28 by a bracket 33, on one hand, and carries the toothed belt gear 17, which is freely rotatable, on the other hand. The coupling 19 connects the toothed belt gear 17 to the driving device 20 that is rigidly attached to the printing press frame. The coupling 19 is able to transmit rotary movements of offset shafts synchronously.

The levers 7 are extended beyond the delivery paddle wheel 1 on the side opposite the shaft 8. A web 34 connects the two levers 7. Roller levers 35, which carry the rollers 22 and are also pivotable around the axis 2, are also attached to the web 34 between the disk-shaped paddle parts 23 and 23'. The cam plates 9 and the rollers 22 thus form a unit, regardless of their actual position. Each of the rollers 22 is driven separately by a drive unit 36, which is adjusted to the rotation of the cam plates 9.

The levers 7 are pivoted around the axis 2 of the delivery paddle wheel by known means (not shown), which can be operated both automatically and manually. The swiveling can take place while the press is running or with the press stopped.

While a specific embodiment of the invention has been shown and described in detail to illustrate the application of the principles of the invention, it will be understood that the invention may be embodied otherwise without departing from such principles.

What is claimed is:

1. A device for reducing the velocity of impact of printed products in the base of a delivery paddle wheel in the folding device of a rotary printing press, comprising: disk-shaped paddle parts forming the delivery paddle wheel and having intermediate zones between said disk-shaped paddle parts; a rotated cam plate in operative connection with a roller to form a cam plate-roller pair, said cam plate-roller pair being positioned in said intermediate zone of said disk-shaped paddle parts of the delivery paddle wheel, said cam plate being non-rotatably mounted on a cam plate shaft which is mounted rotatably on at least one lever arranged outside the delivery paddle wheel, said lever being pivotable around the paddle wheel axis; a rocking lever having a pivoted end mounted on the cam plate shaft and another end provided with a rigidly mounted pin, said rigidly mounted pin being guided between longitudinal guides rigidly connected to a frame of the rotary printing press; a drive member mounted on said pin of the rocking lever for driving said cam plate shaft at a transmission ratio which is substantially the same as the ratio of the effective length of the lever to the effective length of the rocking lever, said drive member mounted on said pin of said rocking lever driving said cam plate-roller pair for reducing the velocity of the printed products.

2. A device for reducing the velocity of impact of printed products in the base of a delivery paddle wheel in the folding device of a rotary printing press, the device comprising:

disk-shaped paddle parts forming the delivery paddle wheel and having intermediate zones between said disk-shaped parts; a rotated cam plate in operative connection with a roller to form a cam plate-roller pair, said cam plate-roller pair being positioned in said intermediate zone of said disk-shaped paddle parts of the delivery paddle wheel, said cam plates being mounted on a cam plate shaft which is mounted rotatably on at least one lever arranged outside the delivery paddle wheel, said lever being pivotable around the paddle wheel axis and adjustable within a range which includes a middle position;

a rocking lever having a pivoted end mounted on the cam plate shaft and another end provided with a rigidly mounted pin, said rigidly mounted pin being guided between longitudinal guides rigidly connected to a frame of the rotary printing press, said cam plate shaft being driven by a drive member arranged on said pin of the rocking lever at a transmission ratio which is substantially the same as the ratio of the effective length of the lever to the effective length of the rocking lever, said middle position of said lever having said longitudinal guide lying along a line passing through the axis of said delivery paddle wheel and said cam plate, and said pin of said rocking lever being guided radially relative to the delivery paddle wheel.

3. A device according to claim 2, wherein said drive member is connected to a driving device, said driving device being rigidly connected to a printing press frame via an offset shaft coupling device.

4. A device according to claim 2, wherein said drive member is a toothed belt gear mounted rotatably on said pin, said drive member being coupled to a driving device via a coupling, said drive member being connected via a toothed belt to a second toothed belt gear, said second toothed belt gear being mounted on said cam plate shaft.

5. A device according to claim 4, wherein the effective length of said rocking lever is half the effective length of said lever and the diameter of said toothed belt gear is half the diameter of the second toothed belt gear mounted on said cam plate shaft.

6. A device according to claim 2, wherein a second lever is provide, each of said lever and said second lever extending beyond the pivot axis of the paddle wheel, said lever and said second lever being connected to each other by a web outside of the delivery paddle wheel, roller levers carrying rollers are arranged pivotably around the axis of the delivery paddle wheel between the disc-shaped paddle parts, said roller lever being connected to said web.

7. A device for reducing the velocity of impact of printed products in the base of a delivery paddle wheel in the folding device of a rotary printing press, comprising:

disk-shaped paddle parts forming the delivery paddle wheel and having intermediate zones between said disk-shaped paddle parts;

means for grasping the printed product immediately and only at a tip of said paddle parts, said means having a rotated cam plate in operative connection with a roller to form a cam plate-roller pair, said cam plate-roller pair being positioned in said intermediate zone of said disk-shaped paddle parts of the delivery paddle wheel, said cam plate being non-rotatably mounted on a cam plate shaft which is mounted rotatably on at least one lever arranged outside the delivery paddle wheel, said lever having pivoting means for pointing said cam plate toward the paddle wheel axis during said grasping;

a rocking lever having a pivoted end mounted on the cam plate shaft and another end provided with a rigidly mounted pin, said rigidly mounted pin being guided between longitudinal guides rigidly connected to a frame of the rotary printing press; and a drive member mounted on said pin of the rocking lever for driving said cam plate shaft at a transmission ratio which is substantially the same as the ratio of the effective length of the lever to the effective length of the rocking lever, said drive member mounted on said pin of said rocking lever driving said cam plate-roller pair for reducing the velocity of the printed products.

* * * * *